US006262647B1

(12) United States Patent
Rogers et al.

(10) Patent No.: US 6,262,647 B1
(45) Date of Patent: Jul. 17, 2001

(54) MAGNETIC REED SWITCHING ARRAY

(76) Inventors: William P. Rogers; William V. Jack, both of P.O. Box 598, Collingswood, NJ (US) 08108

( * ) Notice: Subject to any disclaimer, the term of this patent is extended or adjusted under 35 U.S.C. 154(b) by 0 days.

(21) Appl. No.: 09/692,878

(22) Filed: Oct. 23, 2000

(51) Int. Cl.[7] ..... H01H 9/00; H01H 1/66; H01H 51/00

(52) U.S. Cl. ..... 335/206; 335/152

(58) Field of Search ..... 335/112, 151–154, 335/206–208

(56) References Cited

U.S. PATENT DOCUMENTS

| | | | | |
|---|---|---|---|---|
| 3,337,825 | * | 8/1967 | Brooks | 335/206 |
| 3,496,500 | | 2/1970 | Romary . | |
| 3,505,869 | | 4/1970 | Crawford . | |
| 3,564,468 | | 2/1971 | Sablayrolles et al. . | |
| 3,579,159 | | 5/1971 | Posey | 335/205 |
| 3,582,844 | * | 6/1971 | Launt | 335/112 |
| 3,678,485 | | 7/1972 | Jones | 340/177 R |
| 3,721,929 | * | 3/1973 | Gabriel et al. | 335/206 |
| 3,784,942 | | 1/1974 | Eggert | 335/206 |
| 3,928,828 | * | 12/1975 | Kato et al. | 335/112 |
| 3,942,142 | | 3/1976 | Kato et al. | 335/112 |
| 4,019,164 | * | 4/1977 | Deeg | 335/112 |
| 4,037,186 | | 7/1977 | Palmer et al. | 335/206 |
| 4,112,401 | * | 9/1978 | Palmer et al. | 335/206 |
| 4,408,101 | * | 10/1983 | Brodbeck | 335/206 |
| 4,554,422 | * | 11/1985 | Embrey et al. | 200/61.91 |

FOREIGN PATENT DOCUMENTS

| | | | | |
|---|---|---|---|---|
| 896698 | * | 1/1982 | (SU) | 335/206 |

* cited by examiner

*Primary Examiner*—Ramon M. Barrera
(74) *Attorney, Agent, or Firm*—Norman E. Lehrer

(57) ABSTRACT

A plurality of magnetic reed switches are arranged in a plurality of rows and columns. Mounted above the plane of the reed switches but in close proximity thereto is an electromagnet. Stepping motors are capable of moving the electromagnet so as to overly any one of the reed switches. When the electromagnet is in position over a selected switch, it can be energized to selectively turn the switch on or off. A sensing circuit including a Hall effect transistor travels with the electromagnet and senses if the reed switch below the sensor is on or off.

10 Claims, 2 Drawing Sheets

MAGNETIC REED SWITCHING ARRAY

BACKGROUND OF THE INVENTION

The present invention is directed toward a switching array such as used in the telecommunications industry and more particularly toward a magnetic reed switching array which, through the use of a moveable electromagnet, has the ability to selectively activate or deactivate any one of a plurality of magnetic reed switches.

Switching arrays have been used for many years in various industries and in particular in the telecommunications industry for selectively opening or closing a plurality of electrical circuits. Many different types of switches have been employed including electronic switches and metallic contact switches in the form of relays, moveable conductive pins and magnetic reed switches. All, however, suffer from disadvantages.

While electronic switches are relatively fast, they are incapable of passing large signals without loss or distortion. Their uses, therefore, are somewhat limited in switching arrays used by the telecommunications industry.

Metallic contact switches offer many advantages over electronic switches including their ability to pass relatively large signals without loss or distortion. Many schemes have been proposed in an attempt to make large economical metallic contact switching arrays. The most common metallic contact switches are relays and each relay in the array must have its own winding to turn it "on" and "off" necessitating separate power leads connected to each relay. Relay switching arrays frequently employ latching relays so that the power consumed when the relays are "on" does not become excessive. In addition to a permanent or biasing magnet, these latching relays normally require two windings—one to turn the relay on and the other to turn it off. Moreover, with these prior art arrays, an additional contact must be provided on each relay to sense the state of the relay.

Another type of metallic switching array that has been employed uses an array of conductive pins which are inserted into a printed circuit board to make contact between annular rings in holes passing through the board. Stepper motors are used to position an electromechanical head in proper position above a set of holes. The electromechanical head inserts and removes the pins into and out of the desired holes. Switching times are long for this type of array because of the high degree of positioning accuracy (and subsequent small incremental movement) required by the head as well as the need to move unused pins to a repository of unconnected holes for later use. Mechanical wear also limits the life of both the pins and the holes.

Arrays have also been built utilizing magnetic reed switches. As is well known in the art, magnetic reed switches are comprised of contact pairs sealed in a glass envelope. The contacts close under the influence of an applied magnetic field. Reed switches have a usable lifetime measured in millions of operations and are available in a variety of current and voltage ratings.

One familiar use of magnetic reed switches is in the manufacture of reed relays. In such devices, a coil is wound around either one or a multiplicity of reed switches. When current is passed through the coil, the resulting magnetic field causes the reed switch to close. Adding a biasing magnet to the assembly makes a latching reed relay. The strength of the biasing magnet is insufficient to cause the reed switch to close by itself but, when current is passed through the coil, the resulting magnetic field is sufficient to cause the switch to turn on. The switches are turned off by reversing the current to the coil or by activating a second coil of opposite polarity. Prior art magnetic reed switching arrays are shown, for example, in U.S. Pat. Nos. 3,582,844; 3,928,828 and 4,019,164.

Magnetic reed relays are much faster than the other metallic switching arrays discussed above. The time it takes to set or clear a switch is in the tens of milliseconds. Furthermore, they have a much longer life than other switches. However, they suffer from the same drawback of the latching relays discussed above in that each requires its own winding to turn it "on" and "off" necessitating separate power leads connected to each relay. Moreover, an additional contact must be provided on each relay to sense the state of the relay.

At least one system has also been proposed for activating magnetic reed switches in a switching array without the use of individual electromagnets associated with each magnetic reed switch. U.S. Pat. No. 3,721,929 proposes turning magnetic reed switches on or off utilizing a magnet carried on a moveable arm which can be positioned over any selected magnetic reed switch in the array. The patent, however, proposes utilizing a moveable permanent magnet. As a result, the permanent magnet is always energized and care must be taken when moving the permanent magnet into or out of position so as not to activate or deactivate a magnetic reed switch that was not intended as the permanent magnet is moved into its desired position. The only way of accomplishing this would be to also move the permanent magnet away from the plane of the array of magnetic reed switches which obviously requires additional space and the ability to move the magnet in a third direction. Thus, the design proposed in this patent is not advantageous particularly when multiple layers of switching arrays are contemplated.

SUMMARY OF THE INVENTION

The present invention is intended to overcome the deficiencies of the prior art discussed above. It is an object of the present invention to provide a magnetic reed switching array that is less expensive to produce and operate than previous arrays.

It is another object of the present invention to provide a magnetic reed switching array that allows for the remote activation and deactivation of magnetic reed switches without the requirement of a separate electromagnetic coil for each switch.

It is a further object of the present invention to provide a magnetic reed switching array that includes a means for indicating which reed switches are on and which are off.

It is yet another object of the present invention to provide a magnetic reed switching array that is compact and allows for multiple layers of switching arrays to be used and which may share operable components, thereby reducing the size and cost of the system.

In accordance with the illustrative embodiments demonstrating features and advantages of the present invention, there is provided a magnetic reed switching array comprised of a plurality of magnetic reed switches arranged in a plurality of rows and columns. Mounted above the plane of the reed switches but in close proximity thereto is an electromagnet. Stepping motors are capable of moving the electromagnet so as to overly any one of the reed switches. When the electromagnet is in position over a selected switch, it can be energized to selectively turn the switch on or off. A sensing circuit including a Hall effect transistor or other magnetic field sensing device travels with the electromagnet and senses if the reed switch below the sensor is on or off.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
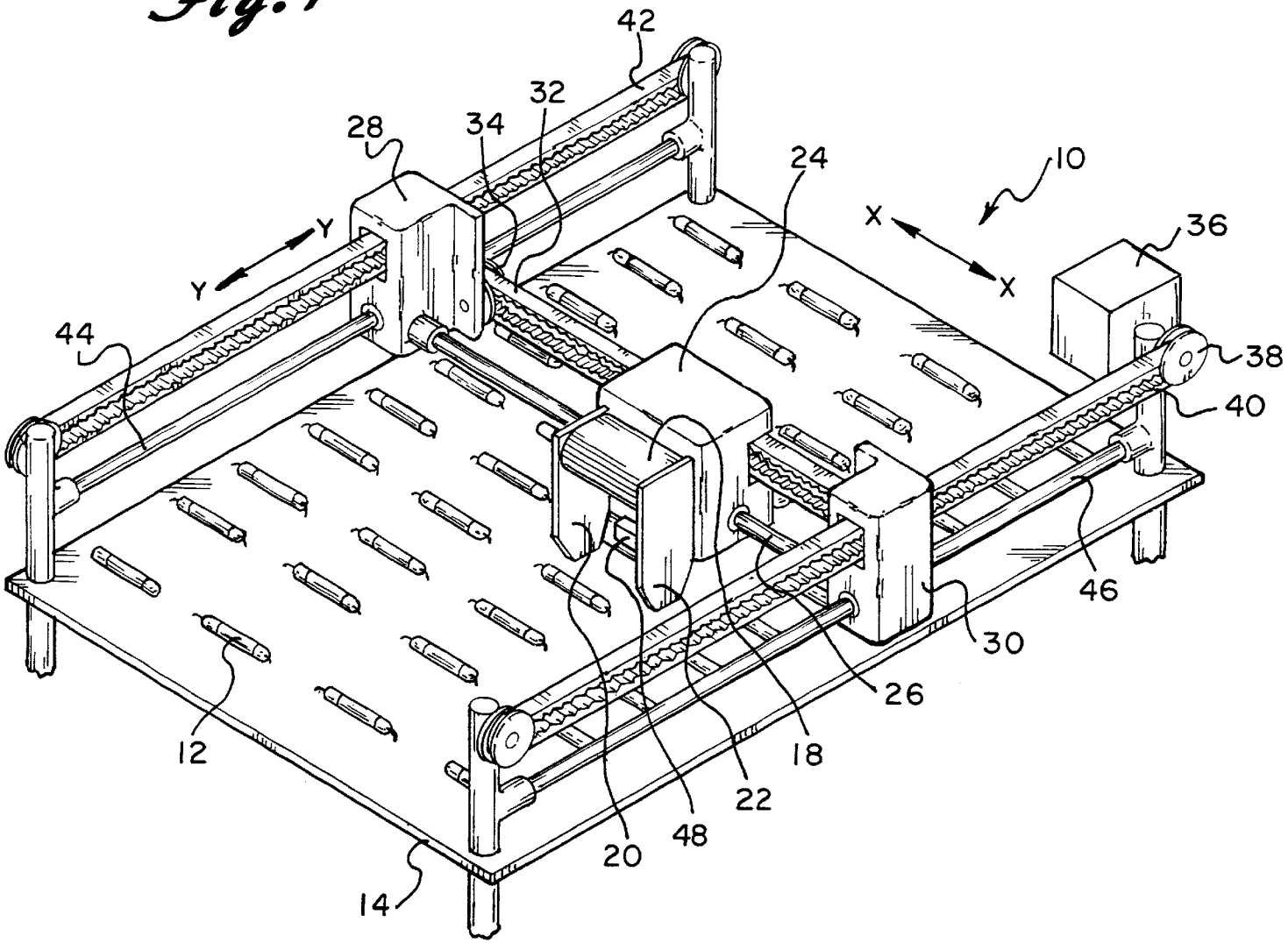
FIG. 1 is a perspective view of a magnetic reed switching array in accordance with the invention.

Referring now to the drawings in detail wherein like reference numerals have been used throughout the various figures to designate like elements, there is shown in FIG. 1 a magnetic reed switching array constructed in accordance with the principles of the present invention and designated generally as 10.

The magnetic reed switching array 10 is comprised of a plurality of magnetic reed switches 12 secured to a substrate 14 which may be a printed circuit board or the like which carries the proper copper clad interconnections on the surface thereof (not shown) in the known manner. In the preferred embodiment of the invention shown in FIG. 1, the plurality of magnetic reed switches 12 lie in a single plane and are arranged in regular rows and columns. As shown, there are four columns and ten rows of switches. This is, however, by way of example only. As will be readily apparent, any number of rows and columns of switches 12 could be utilized with the present invention and it is not necessary that they be precisely in rows and columns. And while it is preferred to have some type of regular array, this also is not absolutely necessary with the present invention.

Located beneath each of the magnetic reed switches 12 is a biasing magnet 16. The magnetic field imposed upon the reed switch 12 by the biasing magnet 16 is not sufficiently strong, by itself, to close the switch contacts. The force is, however, strong enough to hold the contacts closed once they are in the closed or "on" position. The magnetic reed switches 12 and the manner in which they are biased by the use of a biasing magnet 16 are, per se, well known to those skilled in the art. Accordingly, the specific details of the operation of such switches will not be described herein. It should be noted, however, that while reference is made to the biasing magnet 16 biasing the magnetic reed switch 12 into the closed position, it is also possible to utilize normally closed magnetic switches that can be biased into the on position. In the preferred embodiment of the invention, however, the magnetic reed switches 12 are normally open and are biased toward the closed position by the magnets 16.

Located above the magnetic reed switches 12 is a direct current electromagnet 18 having a core including spaced apart poles 20 and 22. In the manner to be described more fully hereinafter, the electromagnet 18 is mounted for movement in a plane substantially parallel to the plane of the reed switches 12 so that the electromagnet can selectively overlie any one of the plurality of magnetic reed switches 12. That is, the electromagnet 18 can move left and right as viewed in FIG. 1, i.e., along the x axis and it can move up and down as viewed in FIG. 1, i.e., along the y axis. The x and y directions of movement are also illustrated in FIGS. 2 and 3.

Figure 2:
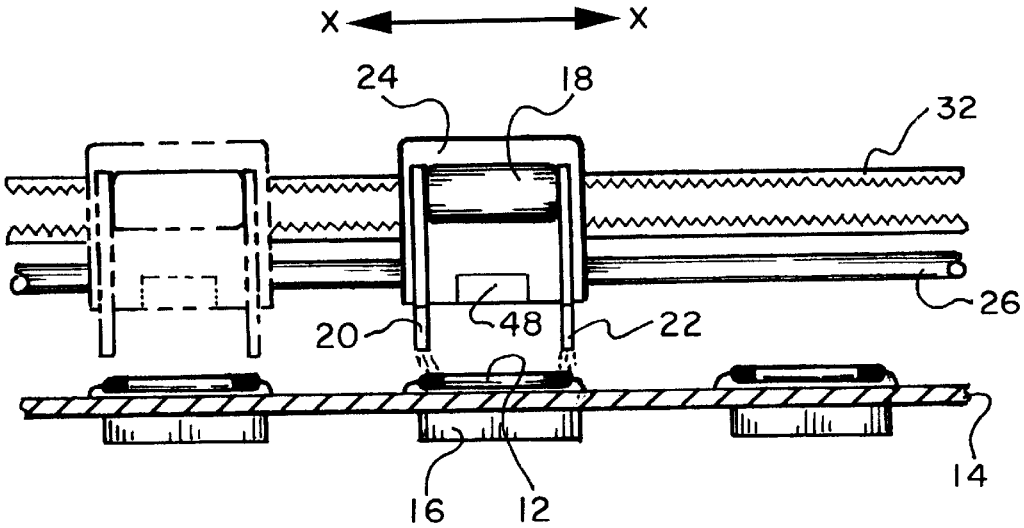
FIG. 2 is a front elevational view of a portion of the switching array of FIG. 1 illustrating the movement of the moveable electromagnet is a first direction.
Figure 3:
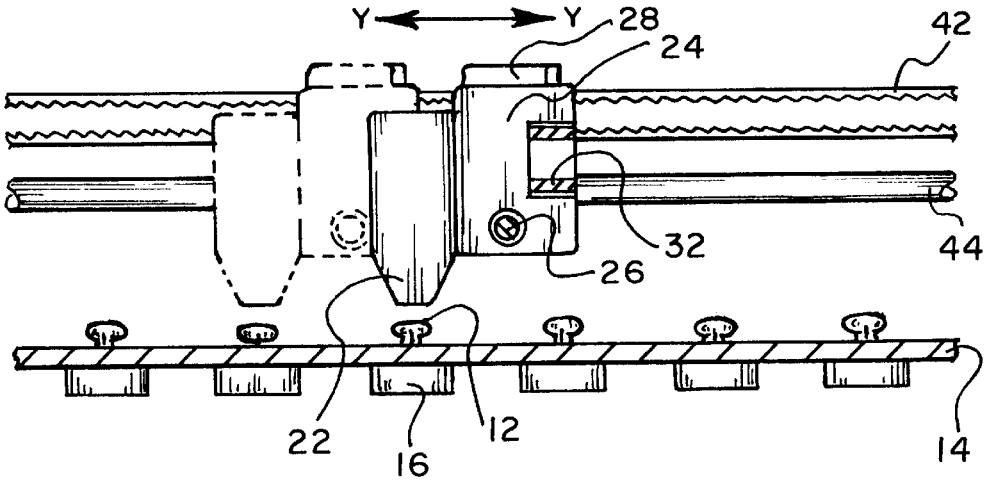
FIG. 3 is a side elevational view of a portion of the switching array of FIG. 1 showing the movement of the moveable electromagnet is a second direction.

When the electromagnet 18 is properly positioned over a selected magnet reed switch such as shown in solid lines in FIGS. 2 and 3, it can then be energized so as to selectively activate or deactivate the selected reed switch 12. That is, when current passes through the electromagnet 18 so that the magnetic field created in the poles 20 and 22 compliments that of the permanent magnet 16, the switch 12 is closed and, as a result of the biasing permanent magnet 16, it remains closed. When it is desired to open a switch, the electromagnet is arranged so as to overlie the switch and is energized in the opposite direction so that the magnetic field created between the poles 20 and 22 is opposite that of the biasing permanent magnet 16. Again, once the magnetic reed switch 12 is open, it will remain in its deactivated or open position.

One arrangement for moving the electromagnet 18 in the desired manner is shown most clearly in FIG. 1. As can be seen, the electromagnet 18 is mounted to a moveable head 24 which is mounted for sliding motion along the x axis on the guide rod 26. The ends of the rod 26 are secured to left and right moveable blocks 28 and 30, respectively. Movement of the head 24 along the x axis is effectuated by the drive belt 32 which passes over pulleys such as shown at 34 on the left and right guide blocks 28 and 30. Located within one of the left and/or side blocks 28 and 30 is a stepping motor (not shown) which is utilized to rotate the pulley 34 and move the drive belt 32 so as to move the head 24 through a selected distance.

Vertical movement, that is movement along the y axis is effectuated by a second stepping motor 36. Stepping motor 36 drives pulley 38 which, in turn, moves belt 40 shown on the right side of FIG. 1. Stepping motor 36 can simultaneously drive the belt 42 on the left side of the reed switching array 10 shown in FIG. 1. Alternatively, a second stepping motor synchronized with stepping motor 36 could be employed.

The belts 42 and 40 are connected to the left and right guide blocks 28 and 30, respectively so as to move them a selected distance when the stepping motor 36 is activated. The guide blocks 28 and 30 are guided for movement in the vertical direction, i.e., along the y axis through the use of left and right guide rods 44 and 46, respectively, that pass through the guide blocks 28 and 30.

The system described above for moving the head 24, i.e., the combination of the various stepping motors, guide rods, pulleys, blocks and belts is, per se, known in various arts. These types of systems are used, for example, in printers and plotters and the like to move a print head or stylus etc. As is also well known to persons skilled in the art, the use of stepping motors or similar devices not only allows for relatively precise movement of the head 28 but also can provide information as to the exact located of the head 24 at any time. Thus, utilizing well known technology, the exact position of the head 24 can be established at any time and, accordingly, it will always be known as to which magnetic reed switch 12 the electromagnet 18 overlies. This information is, of course, necessary in order to know that the electromagnet overlies a particular reed switch in order to turn the same on or off. The information, however, is also important since it can be used to determine whether a particular magnetic reed switch 12 is in the on or off position.

The foregoing is accomplished through the use of a sensor circuit 48 carried by the head 24 so as to be in the vicinity of the magnetic reed switch 12 over which the electromagnet 18 is positioned. The sensing circuit 48 includes a Hall effect transistor (not shown) which is capable of measuring magnetic field strength. As should be readily apparent to those skilled it the art, the magnetic field above a reed switch 12 which is being held in its closed position by the biasing permanent magnet 16 will differ from the magnetic field above an open reed switch. These differing fields can be detected or sensed by the Hall effect transistor. Thus, by positioning the sensing circuit 48 over any one of the magnetic reed switches 12, the state of the reed switch, i.e., whether it has been activated or deactivated can be determined and this information can be sent back to a central processing unit which will correlate the sensed signal with the position of the head 24 to thereby determine which switches are on and which are off.

The arrangement discussed above provides the additional advantage of allowing a second substrate containing reed switches with magnets to be placed above the substrate 14 but face to face with the substrate 14. That is, the reed switches 12 on the substrate 14 will face up while the reed switches on the second, overlying substrate will face down. The head 24 can then carry a second electromagnet facing upwardly and may also include a second sensor circuit. As a result, a single set of stepping motors and drive system can be utilized to move two different electromagnets and sensors along two different arrays of magnetic reed switches. The cost of the positioning assembly is, therefore, spread over a larger number of switches making the present system much more economical than preexisting systems.

The present invention may be embodied in other specific forms without departing from the spirit or essential attributes thereof and accordingly, reference should be made to the appended claims rather than to the foregoing specification as indicating the scope of the invention.

We claim:

1. A magnetic reed switching array comprising:

a plurality of magnetic reed switches arranged in substantially the same plane in a plurality of rows and a plurality of columns;

each of said reed switches being movable by an external magnetic force between a deactivated open position and an activated closed position;

each of said reed switches including a biasing magnet for biasing said switch into one of said positions;

a direct current electromagnet mounted for movement in a plane substantially parallel to said plane of said reed switches so that said electromagnet can selectively overlie any one of said plurality of reed switches;

means for moving said electromagnet so as to overlie one of said reed switches and means for energizing said electromagnet when overlying said one of said reed switches for selectively activating or deactivating said reed switch.

2. The magnetic reed switching array as claimed in claim 1 wherein said moving means moves said electromagnet across said rows and up and down said columns.

3. The magnetic reed switching array as claimed in claim 2 wherein said moving means is capable of stopping said electromagnet at substantially any position within said rows and columns.

4. The magnetic reed switching array as claimed in claim 3 wherein said moving means is comprised of a pair of stepping motors.

5. The magnetic reed switching array as claimed in claim 4 wherein one of said stepping motors moves said electromagnet across said rows and the other of said stepping motors moves said electromagnet up and down said columns.

6. The magnetic reed switching array as claimed in claim 1 including means for providing information concerning the position of said electromagnet within said array.

7. The magnetic reed switching array as claimed in claim 1 further including means for sensing whether a particular reed switch is in its deactivated position or its activated position.

8. The magnetic reed switching array as claimed in claim 7 wherein said sensing means moves with said electromagnet.

9. The magnetic reed switching array as claimed in claim 8 wherein said sensing means includes a Hall effect transistor.

10. The magnetic reed switching array as claimed in claim 1 including means for reversing the direct current to said electromagnet so that each of said reed switches can be activated or deactivated.

* * * * *